US008720449B2

(12) United States Patent
Dipple

(10) Patent No.: US 8,720,449 B2
(45) Date of Patent: May 13, 2014

(54) CIGAR PUNCH

(75) Inventor: Frank B Dipple, St. Petersburg, FL (US)

(73) Assignee: Cigar Punches, LLC, St. Petersburg, FL (US)

( * ) Notice: Subject to any disclaimer, the term of this patent is extended or adjusted under 35 U.S.C. 154(b) by 816 days.

(21) Appl. No.: 12/971,007

(22) Filed: Dec. 17, 2010

(65) Prior Publication Data

US 2011/0146696 A1 Jun. 23, 2011

Related U.S. Application Data

(60) Provisional application No. 61/287,730, filed on Dec. 18, 2009.

(51) Int. Cl.
*A24F 13/24* (2006.01)

(52) U.S. Cl.
USPC ..... 131/255; 131/253

(58) Field of Classification Search
USPC ..... 131/255, 253, 254; 30/110, 111, 112, 30/113, 113.1, 113.2, 113.3
See application file for complete search history.

(56) References Cited

U.S. PATENT DOCUMENTS

| | | | | |
|---|---|---|---|---|
| 282,764 | A | 8/1883 | Peavey | |
| 308,906 | A | 12/1884 | Larsen et al. | |
| 376,511 | A | 1/1888 | Carter | |
| 436,269 | A | 9/1890 | Scholer | |
| 703,162 | A | 6/1902 | Todd, Jr. | |
| 706,679 | A | 8/1902 | Mountford | |
| 738,540 | A | 9/1903 | Hopkins | |
| 807,202 | A | 12/1905 | Pintz | |
| 925,158 | A | 6/1909 | Cragg | |
| 1,284,566 | A | 11/1918 | Benson | |
| 1,734,620 | A | 3/1928 | Giacopini | |
| 1,910,342 | A | 6/1932 | Kivikink | |
| 2,832,354 | A | 4/1958 | Miller | |
| 2,843,135 | A | 5/1966 | Lisiewski | |
| 4,733,674 | A * | 3/1988 | Sielck et al. | 131/255 |
| 5,535,763 | A | 7/1996 | Conte | |
| 5,678,574 | A | 10/1997 | Huang et al. | |
| 5,765,569 | A | 6/1998 | Kemanjian | |
| 5,771,581 | A | 6/1998 | Smith | |
| 5,799,662 | A | 9/1998 | Conte | |
| 5,806,532 | A | 9/1998 | Kuenzel | |
| 5,862,808 | A | 1/1999 | Albarello | |
| 6,032,679 | A * | 3/2000 | McGlauflin | 131/255 |
| 6,070,593 | A | 6/2000 | Chase | |
| 6,341,610 | B1 | 1/2002 | Chuan | |
| 2004/0020501 | A1 * | 2/2004 | Chenelle | 131/248 |
| 2005/0257797 | A1 * | 11/2005 | Taylor | 131/248 |
| 2009/0133705 | A1 * | 5/2009 | Smith | 131/255 |

* cited by examiner

*Primary Examiner* — Richard Crispino
*Assistant Examiner* — Donnie W Mayes
(74) *Attorney, Agent, or Firm* — Brian D. Bellamy

(57) ABSTRACT

A cigar punch with retractable plunger that includes a housing that has a cutting edge and an end-to-end passage having two sub-passages with different cross-sectional area. The cigar punch further includes a plunger extending through the housing and protruding from the cutting edge of the housing. The plunger includes at least one locking pin and a knob. The cigar punch further includes a biasing means to bias the plunger head for movement towards the cutting end when the plunger is in retracted position. To cut the cigar plug, the plunger is retracted and locked using locking means, thereby compressing biasing means and exposing the cutting edge to cut and hold a cigar plug. The plunger is unlocked by twisting the knob. The biasing means effects movement of the plunger head towards the cutting end, thereby automatically ejecting plug from within the cigar punch.

20 Claims, 9 Drawing Sheets

CIGAR PUNCH

PRIORITY CLAIM

The present invention claims benefit of U.S. Provisional Application No. 61/287,730 filed on Dec. 18, 2009.

BACKGROUND OF THE INVENTION

1. Field of the Invention

The present invention relates generally to preparing cigars for smoking and, more particularly, concerns a cigar punch to cut out plug from the sealed end of a cigar.

2. Description of Related Art

Cigars have long been popular. Most cigar smokers consider a fine cigar an investment in their enjoyment that is exemplified by numerous cigar shops and cigar lounges established nationwide. Fine quality cigars are manufactured with only one cut end, which is the end that the cigar smoker lights. To preserve freshness of the cigar, the Cigar manufacturers normally close or seal the opposite end, also called the smoking end, of the cigar. However, the sealed end must be cut before a cigar can be smoked, to enable the cigar smoker to draw smoke through the cigar. Opening the sealed end of a cigar is somewhat problematic.

Before the advent of cigar punches and cutters, the conventional method of opening the sealed end of a cigar had been to cut off the entire sealed end of the cigar with a sharp blade or knife, or biting off a portion of the end of the cigar intended to be placed in the mouth. Some cigar smokers still use these methods for opening the sealed end of a cigar. Both of these methods would usually result in the sealed end of a cigar that is to be placed in the mouth becoming tattered and frayed, leaving the cigar smoker with bits of tobacco in his mouth or lips and thus risking possible ingestion of tobacco. These conventional methods lessen the enjoyment and pleasure of smoking a cigar because of the frayed sealed end of the cigar and are for that reason, among others, unacceptable to the connoisseur of fine cigars.

Many cigar punches have been invented to remedy the above-mentioned deficiency. These cigar punches cut out a plug from the sealed end of a cigar and leave the remaining portion of the cigar-cap intact that prevents fraying of the cigar wrapper and avoids bits of tobacco from entering the mouth of a cigar smoker. Some connoisseurs of fine cigars also contend that properly punching the sealed end of a cigar lends itself to a more intense flavor and can help prolong the experience of smoking the cigar by tightening the draw. Additionally, punching the end of a cigar also results in a cooler smoke by preventing overheating through drawing in too much air. For these reasons, among others, connoisseurs of fine cigars prefer using a cigar punch for preparing a cigar for smoking instead of the conventional methods of biting or cutting off the sealed end of a cigar.

Conventional cigar punches generally comprise a plunger having a cutting edge or a blade end that is seated within a housing, wherein the plunger is pushed outwardly to extend out of the housing thereby, exposing the cutting edge or blade end that is then inserted into the sealed end of a cigar and twisted to sever and extract a plug from the sealed end of the cigar. In these conventional cigar punches, the plunger is pushed or extended out of its housing to expose the cutting edge or blade end, thus posing a higher health and safety risk for a person in possession of these cigar punches because of the likelihood of accidentally pushing the plunger. Inadvertently pushing a plunger having a cutting edge or a blade end, for example when a conventional cigar punch is in a user's pocket, will expose the cutting edge or the blade end that can be potentially injurious to the user. Further, the cutting edge or blade end of these conventional cigar punches are likely to get easily deformed and blunted upon impact due to uniform thinness of their side surface and absence of any support in their hollow core. Dull cigar punches need to be sharpened or changed time and again because a dull cigar punch can damage a cigar being punched and can decrease the enjoyment of smoking the cigar. Yet further, in many conventional cigar punches, a plug that is cut and removed from the sealed end of a cigar remains within the cigar punch and has to be ejected manually to clean the cigar punch.

In order to overcome the above-mentioned deficiencies of conventional cigar punches, there is an unmet need for an improved cigar punch.

SUMMARY OF THE INVENTION

Embodiments of the present invention generally relate to a cigar punch for cutting plug of a cigar. The cigar punch includes a housing that has a cutting end and a knob end and a longitudinal passage from the cutting end to the knob end. The passage includes one step resulting in sub-passages with different cross-sectional area having coaxial centroid, the larger sub-passage is at the cutting end and the smaller sub-passage is at the knob end. The housing further includes a cutting edge at the cutting end. The cutting edge is engageable with the end of a cigar for cutting plugs. The housing includes at least one locking slot, the locking slot having a longitudinal leg aligned with the longitudinal passage.

The cigar punch further includes a rotatable and slidable plunger extending through the housing. The plunger includes a plunger head that is lengthwise slidable within the larger sub-passage and protrudes from the cutting end. The plunger further includes a plunger shaft that is lengthwise slidable in the smaller sub-passage. The plunger shaft includes at least one locking pin that projects into the locking slot to facilitate retraction of the plunger. The retention means arrests the locking means from moving into the longitudinal leg of the locking slot. The plunger shaft further includes a knob.

The cigar punch further includes a biasing means to bias the plunger head for movement towards the cutting end when the plunger is in retracted position. To cut the cigar plug, the plunger is retracted and rotated by pulling and twisting the knob. Hence, the biasing means is compressed and the locking means is engaged with the retention means and the cutting edge is exposed to cut and hold a cigar plug. The plunger is again rotated by twisting the knob. The locking means is re-aligned with the longitudinal leg of the locking slot. The biasing means effects movement of the locking means into the longitudinal leg of the locking slot, resulting in movement of the plunger head towards the cutting end and thereby, ejecting any plug from within the larger sub-passage of the housing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, may best be understood by reference to the detailed description that follows taken in conjunction with the accompanying drawings in which;

DETAILED DESCRIPTION OF THE INVENTION

Figure 1:
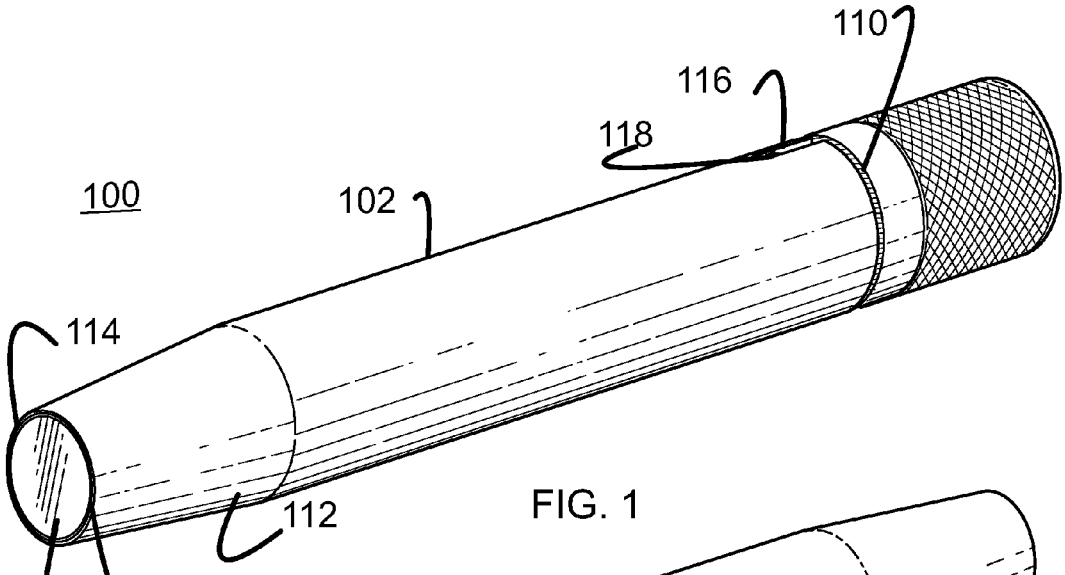
FIGS. 1 and 2 are perspective views of a fully assembled cigar punch in its rest or standby mode, showing its front end and rear end respectively, in accordance with the present invention.

The following description is meant to be exemplary of certain embodiments of the present invention. It should be understood that many other embodiments and variations thereof are also contemplated in the spirit and scope of the present invention.

In describing various embodiments of the present invention, reference will be made herein to FIGS. 1-10 of the drawings in which like numerals refer to like features of the invention. Features of the invention are not necessarily shown to scale in the drawings.

Figure 2:
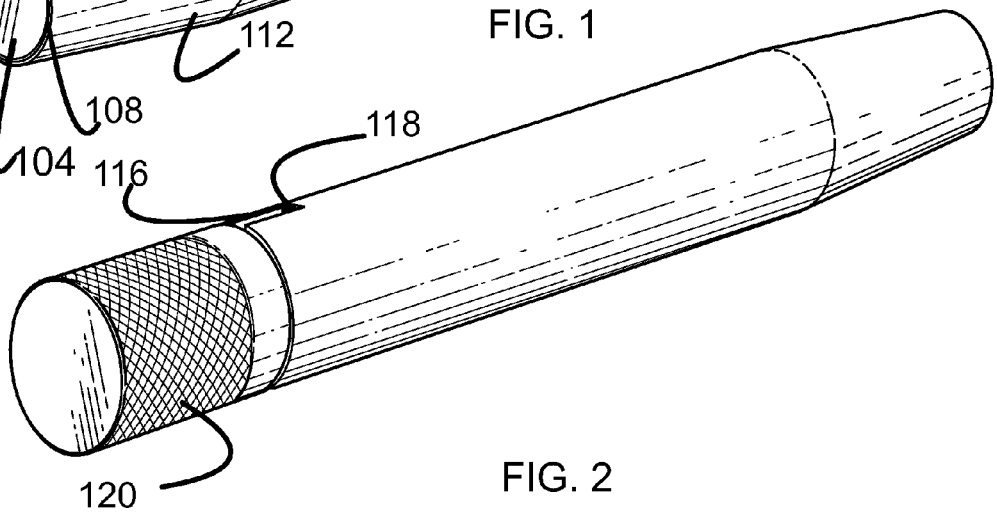

FIG. 1 and FIG. 2 show a cigar punch 100 from its front end and rear end respectively, in its rest or standby mode, according to the present invention. The cigar punch 100 includes a cylindrical housing 102, a plunger 104 and a biasing means (not shown in FIGS. 1 and 2). The cylindrical housing 102 has a cutting end 108 and a knob end 110. The cylindrical housing 102 is tapered at the cutting end 108 and thus includes a tapering 112. The tapering 112 at the cutting end 108 of the cylindrical housing 102 results in a cutting edge 114. The cutting edge 114 is engageable with the sealed end of a cigar (not shown in FIGS. 1 and 2) for cutting plugs. The cylindrical housing 102 further includes at least one locking slot 116 having longitudinal leg at the knob end 110 of the cylindrical housing 102. The plunger 104 is rotatable and slidable within the cylindrical housing 102. The plunger 104 includes at least one locking pin 118. The locking pin 118 projects into longitudinal leg of the locking slot 116 to arrest the rotation of the plunger 104. The plunger 104 further includes a knob 120. The knob 120 is affixed to rear end of the plunger 104 through a screw (not shown in FIGS. 1 and 2). The knob 120 is knurled to aid gripping. The locking pin 118 is removable from the plunger 104. This facilitates disassembly and cleaning of the cigar punch 100.

In one embodiment of the invention, a spring is employed as biasing means. However, those skilled in the art will appreciate that in alternative embodiments, any other biasing means can also be employed without departing from the basic scope thereof. Further, in one embodiment of the present invention, shape of the locking pin is cuboidal. However those skilled in the art will appreciate that in alternative embodiments, shape of the locking pin can also be cylindrical or any other suitable shape that enables it to project into longitudinal leg of the locking slot to arrest plunger rotation when the cigar punch is in its rest or standby mode. Yet further in one embodiment of the present invention, a cylindrical housing is employed for the cigar punch. However those skilled in the art will appreciate that in alternative embodiments, any other housing shape can also be employed without departing from the basic scope thereof.

Figure 3:
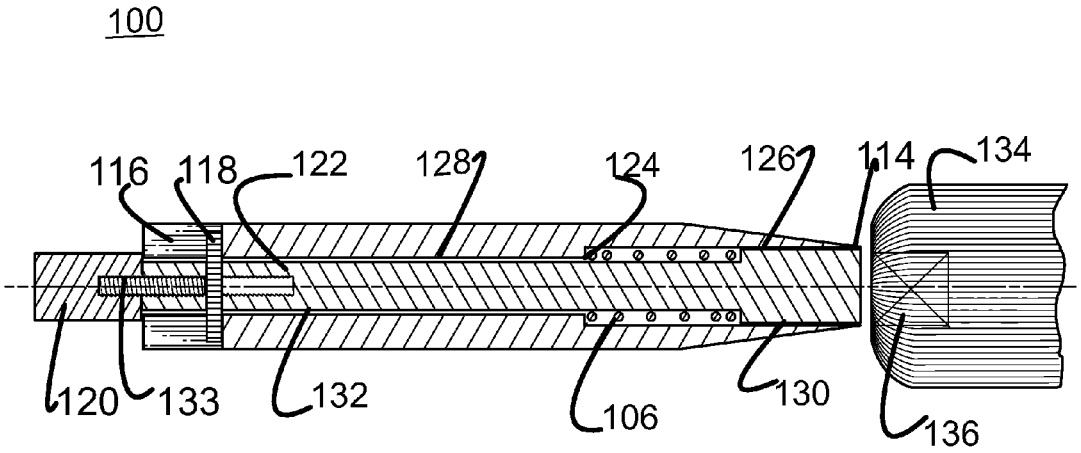
FIG. 3 is simplified cross sectional side view of the cigar punch of FIGS. 1 and 2 in its rest or standby mode, showing various internal details thereof.

FIG. 3 shows a cross-sectional side view of the cigar punch 100 in its rest or standby mode. The cylindrical housing 102 further includes a cylindrical longitudinal passage 122 from the cutting end 108 to the knob end 110. The cylindrical longitudinal passage 122 includes a step 124 that results in two concentric cylindrical sub-passages 126 and 128 with different diameter. The larger sub-passage 126 is at the cutting end 108. The smaller sub-passage 128 is at the knob end 110. The plunger 104 includes a plunger head 130 and a plunger shaft 132. The plunger head 130 is lengthwise slidable within the larger sub-passage 126. The plunger head 130 rests snugly within the larger sub-passage 126 and sliding surface of the plunger head 130 is contiguous to the larger sub-passage 126. The plunger shaft 132 is lengthwise slidable within the smaller sub-passage 128. The plunger shaft 132 rests snugly within the smaller sub-passage 128 and sliding surface of the plunger shaft 132 is contiguous to the smaller sub-passage 128. The plunger shaft 132 includes the locking pin 118 that projects into longitudinal leg of the locking slot 116. The plunger shaft 132 further includes the knob 120. The knob 120 is affixed to rear end of the plunger shaft 132 through a screw 133. The locking pin 118 is attached to the plunger shaft 132 and is held in place by the screw 133 that is inserted through rear end of the plunger shaft 132. Those skilled in the art will appreciate that the locking pin can be attached to the plunger shaft by any other means. The locking pin 118 is removable from the plunger shaft 132, which facilitates disassembly and cleaning of the cigar punch 100. FIG. 3 further shows a spring 106. The spring 106 rests within the larger sub-passage 126 of the cylindrical housing 102 and upon the plunger shaft 132 and is anchored between the step 124 and the plunger head 130, as shown in the FIG. 3. In standby mode of the cigar punch 100, the plunger head 130 protrudes from the cutting edge 114 and the spring 106 remains in its relaxed position. Those skilled in the art will appreciate that protrusion of the plunger head 130 from the cutting edge 114 prevents damage to the cutting edge 114 and provides safety to a user. Because of protrusion of the plunger head 130 from the cutting edge 114, the cutting edge 114 is less likely to get deformed or blunted upon impact and will need less frequent sharpening. Further, protrusion of the plunger head 130 from the cutting edge 114 decreases risk of accidental injury because of the cutting edge 114. FIG. 3 further shows a cigar 134 and a cigar plug 136. For preparing the cigar 134 for smoking, the cigar plug 136 needs to be removed from the cigar 134.

In one embodiment, the cross sectional area of the sub-passages is circular, the sub-passages having co-axial center, and the plunger is a single rigid body having the plunger head at one end and the plunger shaft at the other end, and the plunger rests within concentric cylindrical sub-passages. In alternative embodiments, the cross sectional area of the sub-passages can have any shape, and the sub-passages have coaxial centroid. In these alternative embodiments, the plunger is assembled by connecting one end of the plunger head to one end of the plunger shaft through a pin so as to facilitate rotation of the plunger shaft without the necessity of rotation of the plunger head, wherein the plunger head is lengthwise slidable within the larger sub-passage and the sliding surface of the plunger head is contiguous to the larger sub-passage, and wherein the plunger shaft is rotatable and lengthwise slidable within the smaller sub-passage. Those skilled in the art will appreciate that this alternative embodiment of the invention allows the cutting edge to engage with the sealed end of a cigar to cut plugs of the same shape as that of the cutting edge. The plunger head does not have the necessity of rotating with the plunger shaft, and the plunger head rests within the larger sub-passage and is contiguous to the cutting edge that provides safety to a user and supports the cutting edge against impact.

Figure 4:
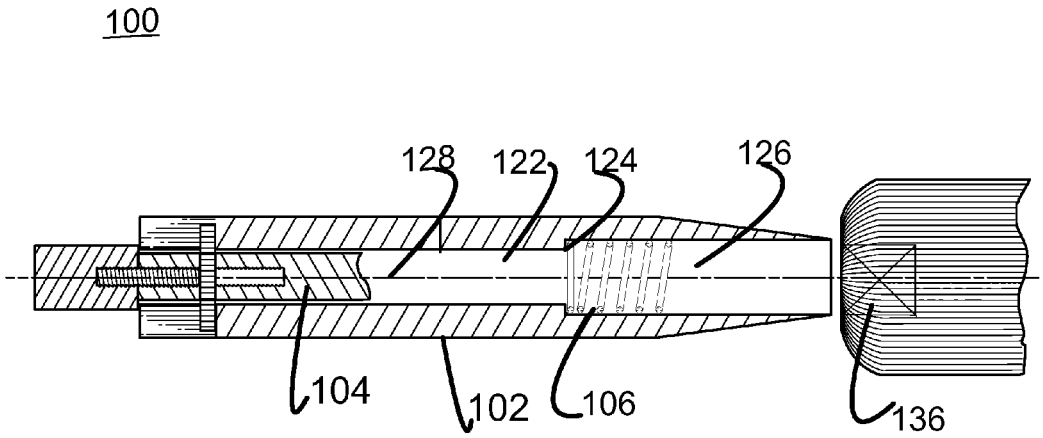
FIG. 4 is the same as FIG. 3, wherein the plunger is further cut away to clearly show internal construction of the housing and removable spring therein.

FIG. 4 shows a simplified cross-sectional side view of the cigar punch 100 wherein, the plunger 104 has been further cut away to clearly show the internal construction of the cylindrical housing 102 wherein, the cylindrical longitudinal passage 122 has the step 124 resulting in the lager sub-passage 126 and the smaller sub-passage 128. The figure also clearly shows the spring 106 seated within the larger sub-passage 126 of the cylindrical housing 102.

Figure 5:
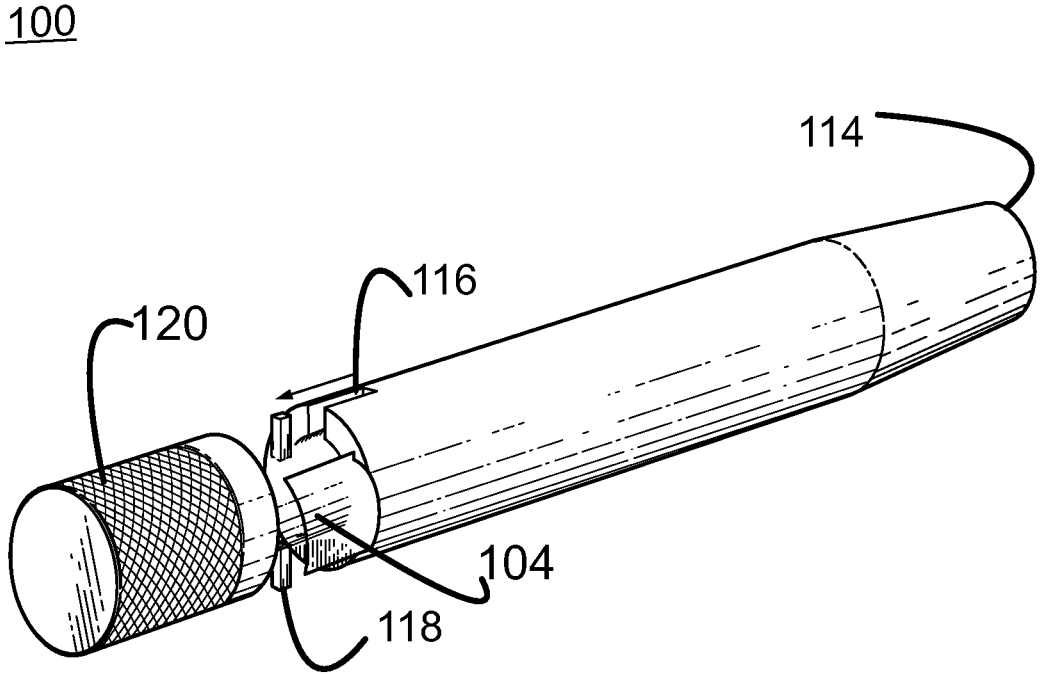
FIG. 5 shows rear perspective view of the cigar punch in its cutting mode wherein, the plunger is in retracted position to enable the cutting edge to be engageable with the sealed end of a cigar to cut and hold a plug.

FIG. 5 shows the cigar punch 100 in cutting mode, wherein the plunger 104 is in retracted position. The plunger 104 is pulled or retracted manually with the help of the knob 120. The plunger 104 is retracted until the locking pin 118 is out of longitudinal leg of the locking slot 116.

Figure 6:
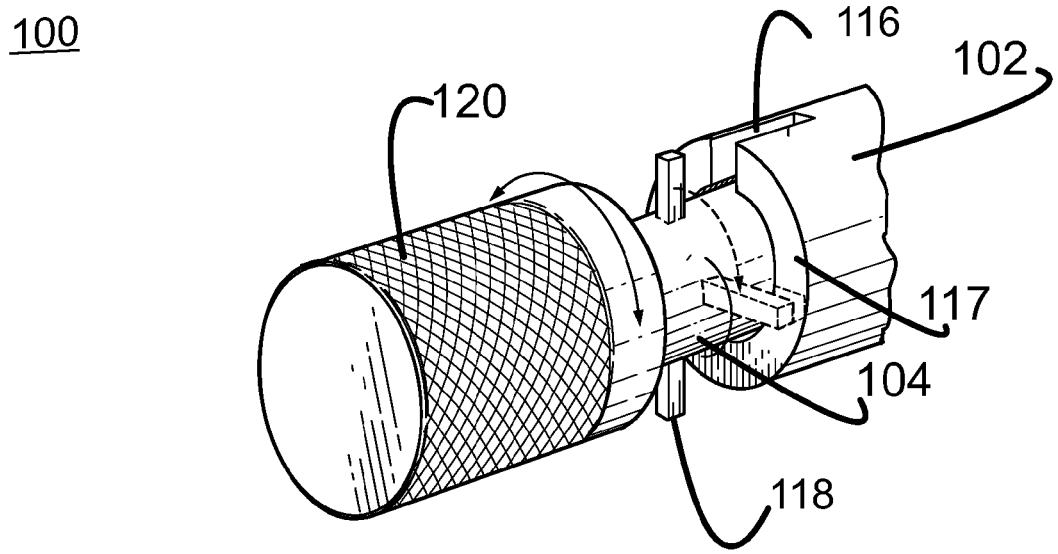
FIG. 6 is an enlarged partial section of rear end of the cigar punch shown in FIG. 5 showing locking means and retention means at rear end of the cigar punch.

FIG. 6 depicts engagement of the locking pin 118 and securing the plunger 104 of the cigar punch 100 in a retracted position. The plunger 104 is retracted manually till the locking pin 118 is out of longitudinal leg of the locking slot 116. The knob 120 is now twisted or rotated to engage the locking pin 118 with unslotted knob end 117 of the cylindrical housing 102, thereby rotating and securing the plunger 104 in a retracted position. The knob 120 can be twisted or rotated in any direction (clockwise or anticlockwise) to engage the locking pin 118 with the unslotted knob end 117 of the cylindrical housing 102.

In one embodiment, the locking slot is a longitudinal locking slot at the knob end of the housing and enables the locking pin to be engageable with the unslotted knob end of the cylindrical housing when the plunger is in retracted position to arrest forward motion of the plunger, the unslotted knob end of the cylindrical housing herein acting as a retention means. However, those skilled in the art will appreciate that in alternative embodiments, the locking slot can also be an opening in wall of the cylindrical housing having at least one longitudinal leg to allow longitudinal movement of the locking pin to facilitate retraction of the plunger, and at least one retention means to arrest forward motion of the plunger. For example, it is envisaged that the locking slot can be L-shaped slot or J-shaped slot in wall of the cylindrical housing, wherein longitudinal leg of the locking slot is longitudinal leg of L-shaped slot or J-shaped slot, and wherein retention means is transverse leg or curved leg of L-shaped slot or J-shaped slot respectively.

Figure 7:
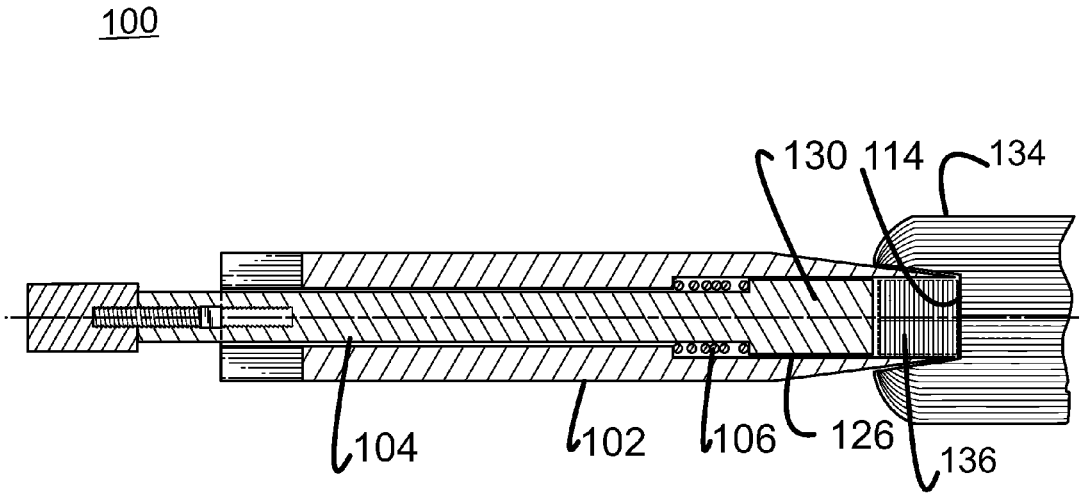
FIG. 7 shows a simplified cross sectional side view of the cigar punch of FIG. 5 in its cutting mode, showing its internal details thereof, and its engagement with the sealed end of a cigar.

FIG. 7 shows cross-sectional side view of the cigar punch 100 in its cutting mode and its engagement with sealed end of the cigar 134. With retraction of the plunger 104, the plunger head 130 moves within the larger sub-passage 126 of the cylindrical housing 102, thereby exposing the cutting edge 114 that is engageable with sealed end of the cigar 134 to cut and hold the cigar plug 136 as shown in the figure. Further, the retraction of the plunger 104 effects compression of the spring 106, as shown in the figure. The exposed cutting edge 114 of the cigar punch 100 is now forcibly inserted into sealed end of the cigar 134 to cut the cigar plug 136. As shown in the FIG. 7, sealed end of the cigar 134 is nested within the cylindrical housing 102 and the cutting edge 114 of the cylindrical housing 102 has been inserted into sealed end of the cigar 134. Insertion of the cutting edge 114 cuts the cigar plug 136. The cigar punch 100 is now taken out of sealed end of the cigar 134. The cigar plug 136 now rests within the larger sub-passage 126 of the cylindrical housing 102. The cigar plug 136 has been cut and removed from the cigar 134. The cigar 134 is now ready to be smoked and enjoyed by a user.

Those skilled in the art will appreciate that the present invention provides extra safety to a user by employing retraction of the plunger for exposing the cutting edge compared to conventional cigar punches wherein plunger is pushed or extended to expose cutting edge or blade end. Inadvertently pushing or extending plunger, for example when a conventional cigar punch is in a user's pocket, will expose the cutting edge or blade end that can be potentially injurious to the user. The present invention overcomes above-mentioned deficiency by employing retraction of the plunger as means for exposing the cutting edge of the cigar punch. Those skilled in the art will appreciate that accidental retraction of plunger is more unlikely than accidental extension of plunger while resting inside a user's pocket or in other circumstances.

Figure 8:
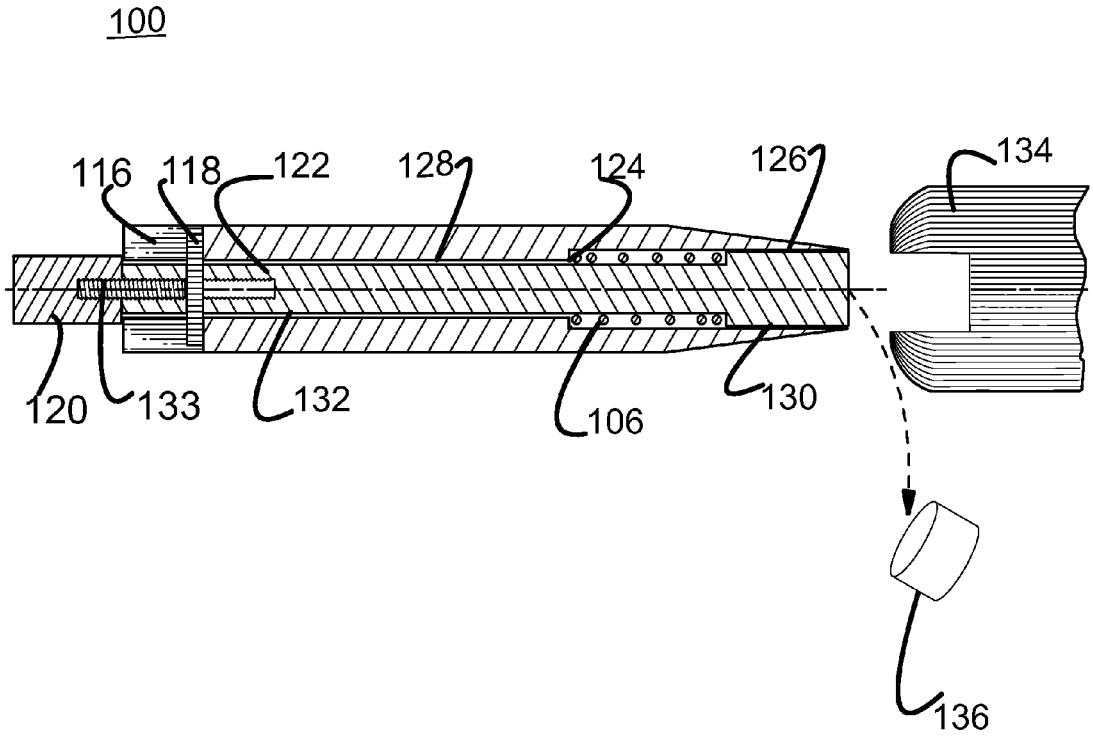
FIG. 8 shows simplified cross sectional side view of the cigar punch of FIG. 7, showing ejection of the cigar plug that was held within the Cigar punch after removing the cigar punch from the sealed end of the cigar.

FIG. 8 shows ejection of the cigar plug 136 cut and held within the cigar punch 100. After removing the cigar punch 100 from sealed end of the cigar 134, the cigar plug 136 rests within the larger sub-passage 126 of the cylindrical housing 102. The present invention provides for automatic ejection of the cigar plug 136. To eject the cigar plug 136 cut and held by the cigar punch 100, the knob 120 is twisted or rotated in either direction until the locking pin 118 is re-aligned with longitudinal leg of the locking slot 116, thus disengaging the locking pin 118 from the unslotted knob end 117 of the cylindrical housing 102. The spring 106 biases movement of the locking pin 118 into the locking slot 116 and effects the forward movement of the plunger 104, by forcing rear end of the plunger head 130, towards the cutting end 108 of the cylindrical housing 102, until the spring 106 returns to its relaxed state, and the locking pin 118 rests within the locking slot 116, thus effecting automatic ejection of the cigar plug 136.

Figure 9:
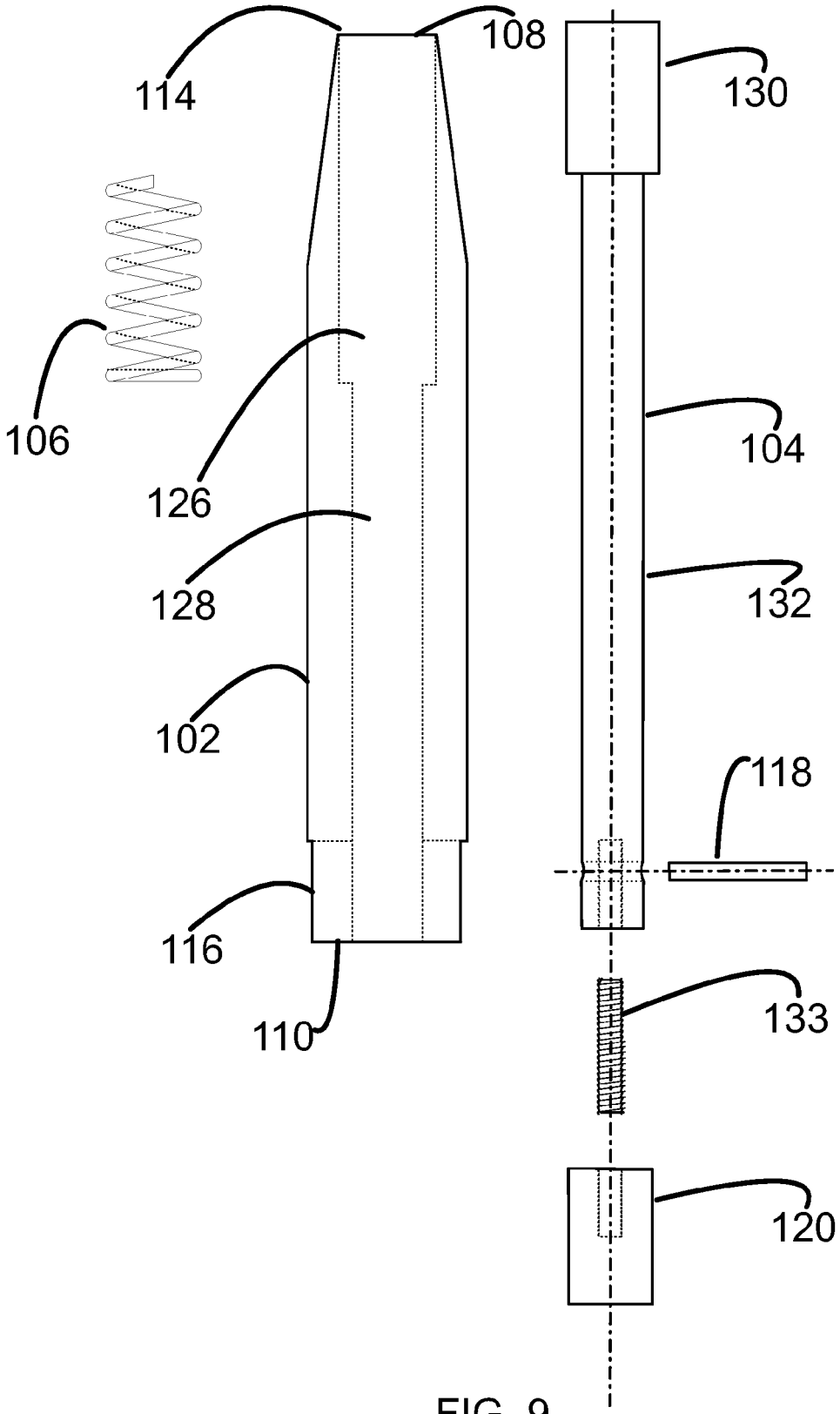
FIG. 9 is an exploded orthogonal side view of the cigar punch showing each component thereof.

FIG. 9 shows exploded orthogonal view of a side of the cigar punch 100 comprising the cylindrical housing 102, the plunger 104, the spring 106, the locking pin 118, the screw 133 and the knob 120, as described from FIG. 1 to FIG. 8. To assemble the cigar punch 100, the spring 106 is put inside the cylindrical housing 102 through its cutting end 108. The spring 106 rests within the larger sub-passage 126 of the cylindrical housing 102. Next the plunger 104 is inserted into the cylindrical longitudinal passage 122 of the cylindrical housing 102, by putting rear end of the plunger shaft 132 into the cylindrical housing 102 through the cutting end 108. The plunger shaft 132 extends through the smaller sub-passage 128 of the cylindrical housing 102 and the plunger head 130 rests within the larger sub-passage 126 of the cylindrical housing 102, with rear end of the plunger head 130 resting upon the spring 106. The plunger head 130 protrudes from the cutting edge 114 of the cigar punch 100. The spring 106 rests upon the plunger shaft 132 and is anchored between the step 124 and the plunger head 130. Next, the locking pin 118 is inserted into the plunger shaft 132 through a hole that is indicated in FIG. 9. The screw 133 is now inserted through rear end of the plunger shaft 132 and the locking pin 118 is held into place by the screw 133. Lastly, the knob 120 is affixed to rear end of the plunger shaft 132 with the help of the screw 133.

Figure 10:
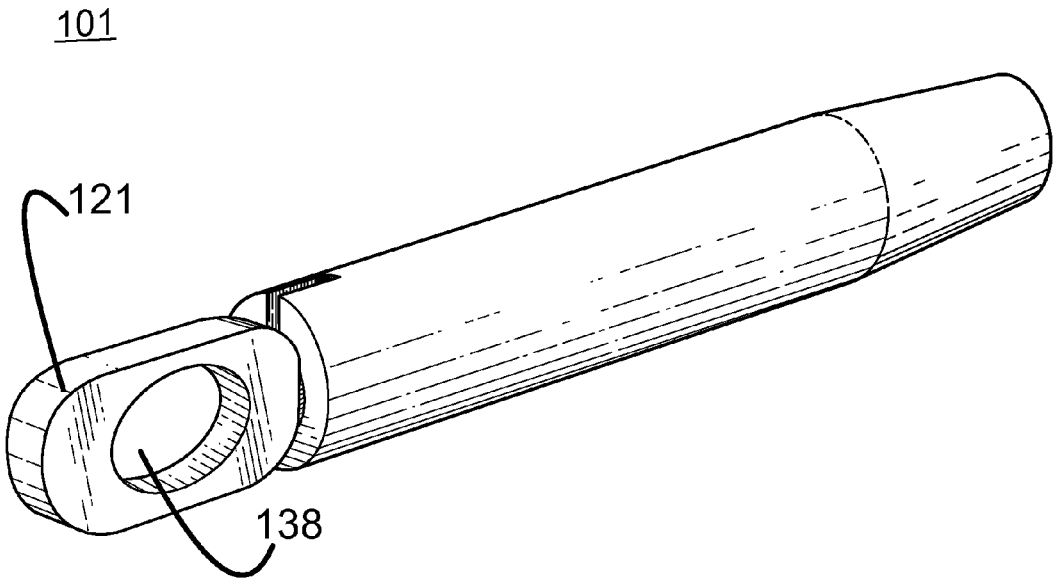
FIG. 10 is a perspective view of a fully assembled cigar punch, according to an alternative embodiment.

FIG. 10 depicts an alternative embodiment of a cigar punch 101, according to the present invention. As shown in the FIG.

10, a knob 121 of the cigar punch 101 includes an aperture 138 to receive objects, for example a key ring. Those skilled in the art will appreciate that the aperture increases the usability of the cigar punch by being able to attach other items to the cigar punch.

The invention advantageously provides an improved cigar punch for cutting cigar plugs and for preparing cigars for smoking. The invention provides extra safety to a user by employing retraction of the plunger to expose the cutting edge, compared to conventional cigar punches where the plunger is pushed forwardly to expose the cutting edge. Inadvertently pushing or extending plunger, for example when a conventional cigar punch is in a user's pocket, will expose the cutting edge or blade end that can be potentially injurious to the user. The present invention overcomes above-mentioned deficiency by employing retraction of the plunger as means for exposing the cutting edge of the cigar punch. Those skilled in the art will appreciate that accidental retraction of plunger is more unlikely than accidental extension of plunger while resting inside a user's pocket or in other circumstances. Further, the invention provides additional safety to a user by employing protrusion of the plunger head from the cutting edge, thus decreasing the likelihood of the user accidentally injuring him by the cutting edge.

Furthermore, the invention provides for preventing damage to the cutting edge of the cigar punch. In conventional cigar punches, the cutting edge or blade end are likely to get easily deformed and blunted upon impact due to uniform thinness of their side surface and absence of any support in their hollow core. Dull cigar punches need to be sharpened or changed time and again because a dull cigar punch can damage a cigar being punched and can decrease the enjoyment of smoking the cigar. In the present invention, tapering at the cutting end advantageously provides additional support to the cutting edge and prevents blunting or deformity of the cutting edge. Further, the plunger head is contiguous to and protruding from the cutting edge and hence decreases the likelihood of damage to the cutting edge upon impact and the cigar punch will need less frequent sharpening. Protrusion of the plunger head will lessen the likelihood of frontal impact upon the cutting edge, thus preventing blunting of the cutting edge. Contiguity of the plunger head to the cutting edge will provide internal support to the cutting edge, thus preventing deformity of the cutting edge.

While the foregoing is directed to embodiments of the present invention, other and further embodiments of the invention may be devised without departing from the basic scope thereof.

The invention claimed is:

1. A cigar punch with retractable plunger, comprising:

a cylindrical housing having a cutting end and a knob end and having a cylindrical longitudinal passage from the cutting end to the knob end, the passage having one step resulting in concentric cylindrical sub-passages with different diameter, the larger sub-passage being at the cutting end and the smaller sub-passage being at the knob end, the cutting end being tapered resulting in a cutting edge, the cutting edge being engageable with the end of a cigar for cutting plugs, the housing having at least one longitudinal locking slot at the knob end;

a rotatable and slidable plunger extending through the housing, the plunger having a plunger head that is lengthwise slidable within the larger sub-passage and protruding from the cutting end, sliding surface of the plunger head being contiguous to the larger sub-passage, the plunger further having a plunger shaft that is lengthwise slidable within the smaller sub-passage, sliding surface of the plunger shaft being contiguous to the smaller sub-passage, the plunger shaft having at least one locking pin that projects into the longitudinal locking slot to facilitate retraction of the plunger, the plunger shaft further having a knob; and a spring biasing the plunger head for movement towards the cutting end when the plunger is in retracted position, whereby, upon retracting and rotating the plunger by pulling and twisting the knob, the locking pin is engaged with unslotted knob end of the housing and the cutting edge is exposed to cut and hold a cigar plug and whereby, upon further rotating the plunger by twisting the knob, the locking pin is re-aligned with the longitudinal locking slot, the spring biases movement of the locking pin into the longitudinal locking slot thereby, effecting movement of the plunger head towards the cutting end and thereby, ejecting any plug from within the larger sub-passage of the housing.

2. A cigar punch with retractable plunger according to claim 1 wherein: the knob is a knurled knob that aids gripping.

3. A cigar punch with retractable plunger according to claim 1 wherein: the knob having an aperture to receive a key ring.

4. A cigar punch with retractable plunger according to claim 1 wherein: the knob is affixed to rear end of the plunger shaft through a screw.

5. A cigar punch with retractable plunger according to claim 4 wherein: the locking pin is attached to the plunger shaft through the screw.

6. A cigar punch with retractable plunger according to claim 1 wherein: the spring rests upon the plunger shaft and within the larger sub-passage.

7. A cigar punch with retractable plunger according to claim 1 wherein: the plunger protrudes from the cutting end of the cylinder to provide safety to a user and to prevent damage to the cutting end.

8. A cigar punch with retractable plunger, comprising:

a housing having a cutting end and a knob end and having a cylindrical longitudinal passage from the cutting end to the knob end, the passage having one step resulting in concentric cylindrical sub-passages with different diameter, the larger sub-passage being at the cutting end and the smaller sub-passage being at the knob end, the housing having a cutting edge at the cutting end, the cutting edge being engageable with the end of a cigar for cutting plugs, the housing having at least one locking slot, the locking slot having at least one longitudinal leg aligned with the longitudinal passage and having at least one retention means;

a rotatable and slidable plunger extending through the housing, the plunger having a plunger head that is lengthwise slidable within the larger sub-passage and protruding from the cutting end, the plunger further having a plunger shaft that is lengthwise slidable within the smaller sub-passage, the plunger shaft having at least one locking means that projects into the locking slot to facilitate retraction of the plunger, the retention means arrests the locking means from moving into the longitudinal leg of the locking slot; the plunger shaft further having a knob; and biasing means to bias the plunger head for movement towards the cutting end when the plunger is in retracted position, whereby, upon retracting and rotating the plunger by pulling and twisting the knob, the biasing means is compressed and the locking means is engaged with the retention means and the cutting edge is exposed to cut and hold a cigar plug and whereby, upon further rotating the plunger by twisting the knob, the locking means is re-aligned with the longitudinal leg of the locking slot, the biasing means effecting movement of the locking means into the longitudinal leg of the locking slot thereby, effecting movement of the plunger head towards the cutting end and thereby, ejecting any plug from within the larger sub-passage of the housing.

9. A cigar punch with retractable plunger according to claim 8 wherein: the biasing means is a spring that rests between the larger sub-passage and the plunger shaft.

10. A cigar punch with retractable plunger according to claim 8 wherein: sliding surface of the plunger head is contiguous to the larger sub-passage.

11. A cigar punch with retractable plunger according to claim 8 wherein: the locking slot in the housing is a longitudinal slot at the knob end thereby, enabling the locking means to be engageable with the retention means when the plunger is retracted wherein, the retention means is unslotted knob end of the housing.

12. A cigar punch with retractable plunger according to claim 8 wherein: the locking means is attached to the plunger shaft through a screw.

13. A cigar punch with retractable plunger according to claim 8 wherein: the locking means is removable from the plunger shaft to facilitate disassembly and cleaning of the cigar punch.

14. A cigar punch with retractable plunger, comprising:

a housing having a cutting end and a knob end and having a longitudinal passage from the cutting end to the knob end, the passage having one step resulting in sub-passages with different cross-sectional area, the larger sub-passage being at the cutting end and the smaller sub-passage being at the knob end, the housing having a cutting edge at the cutting end, the cutting edge being engageable with the end of a cigar for cutting plugs, the housing having at least one locking slot, the locking slot having at least one longitudinal leg aligned with the longitudinal passage and having at least one retention means;

a plunger head that is lengthwise slidable within the larger sub-passage and protruding from the cutting end;

a rotatable plunger shaft extending through the smaller sub-passage and that is lengthwise slidable within the smaller sub-passage, the plunger shaft having at least one locking means that projects into the locking slot to facilitate retraction of the plunger shaft, the retention means arrests the locking means from moving into the longitudinal leg of the locking slot; the plunger shaft further having a knob;

a pin that connects one end of the plunger head to one end of the plunger shaft, the pin facilitates rotating motion of the plunger shaft while keeping the plunger head still; and biasing means to bias the plunger head for movement towards the cutting end when the plunger shaft is in retracted position, whereby, upon retracting and rotating the plunger shaft by pulling and twisting the knob, the biasing means is compressed and the locking means is engaged with the retention means and the cutting edge is exposed to cut and hold a cigar plug and whereby, upon further rotating the plunger shaft by twisting the knob, the locking means is re-aligned with the longitudinal leg of the locking slot, the biasing means effecting movement of the locking means into the longitudinal leg of the locking slot thereby, effecting movement of the plunger head towards the cutting end and thereby, ejecting any plug from within the larger sub-passage of the housing.

15. A cigar punch with retractable plunger according to claim 14 wherein: the biasing means is a spring that rests between the larger sub-passage and the plunger shaft.

16. A cigar punch with retractable plunger according to claim 14 wherein: sliding surface of the plunger head is contiguous to the larger sub-passage.

17. A cigar punch with retractable plunger according to claim 14 wherein: the sub-passages have coaxial centroid.

18. A cigar punch with retractable plunger according to claim 14 wherein: the locking slot in the housing is a longitudinal slot at the knob end thereby, enabling the locking means to be engageable with the retention means when the plunger is retracted wherein, the retention means is unslotted knob end of the housing.

19. A cigar punch with retractable plunger according to claim 14 wherein: the locking slot in the housing is a L-shaped or a J-shaped opening in the housing wall thereby, enabling the locking means to be engageable with the retention means when the plunger is retracted wherein, the retention means is the transverse leg of the L-shaped locking slot or the curved leg of the J-shaped locking slot.

20. A cigar punch with retractable plunger according to claim 14 wherein: the locking means is removable from the plunger shaft to facilitate disassembly and cleaning of the cigar punch.

* * * * *